US011430395B2

(12) United States Patent
Hong

(10) Patent No.: US 11,430,395 B2
(45) Date of Patent: Aug. 30, 2022

(54) DISPLAY DEVICE AND DRIVING CIRCUIT

(71) Applicant: LG Display Co., Ltd., Seoul (KR)

(72) Inventor: MooKyoung Hong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/463,986

(22) Filed: Sep. 1, 2021

(65) Prior Publication Data

US 2022/0148518 A1 May 12, 2022

(30) Foreign Application Priority Data

Nov. 9, 2020 (KR) ..... 10-2020-0148579

(51) Int. Cl.
*G09G 3/3291* (2016.01)

(52) U.S. Cl.
CPC ... *G09G 3/3291* (2013.01); *G09G 2300/0842* (2013.01); *G09G 2310/027* (2013.01); *G09G 2310/08* (2013.01)

(58) Field of Classification Search
CPC ..... G09G 2320/043; G09G 2300/0819; G09G 2320/0233
See application file for complete search history.

(56) References Cited

U.S. PATENT DOCUMENTS

| | | | | |
|---|---|---|---|---|
| 9,076,387 | B1 * | 7/2015 | Lee | G09G 3/3258 |
| 10,339,872 | B2 * | 7/2019 | Park | G09G 3/3208 |
| 2014/0176622 | A1 * | 6/2014 | Jung | G09G 3/3208 345/76 |
| 2016/0063950 | A1 * | 3/2016 | Shin | G09G 3/3233 345/212 |
| 2016/0189615 | A1 * | 6/2016 | Kwon | G09G 3/3258 345/76 |
| 2017/0004776 | A1 * | 1/2017 | Park | G09G 3/3233 |
| 2018/0144689 | A1 * | 5/2018 | Hong | G09G 3/3275 |
| 2019/0027095 | A1 * | 1/2019 | Kim | H01L 51/5203 |
| 2021/0193056 | A1 * | 6/2021 | Piao | G09G 3/3275 |

* cited by examiner

*Primary Examiner* — Sepehr Azari
(74) *Attorney, Agent, or Firm* — Birch, Stewart, Kolasch & Birch, LLP

(57) ABSTRACT

A display device and a driving circuit are discussed. According to an embodiment of the present disclosure, it is possible to reduce a compensation offset for a driving characteristic value of a display panel. In addition, according to an embodiment of the present disclosure, the number of times of detecting a dummy sensing voltage through a dummy channel is greater than the number of times of detecting a sensing voltage through a sensing channel, thereby reducing the compensation offset. Further, according to an embodiment of the present disclosure, offset noise can be reduced by accumulating a dummy sensing voltage repeatedly detected through the dummy channel.

17 Claims, 11 Drawing Sheets

(a)

(b)

DISPLAY DEVICE AND DRIVING CIRCUIT

CROSS REFERENCE TO RELATED APPLICATION

This application claims priority from Korean Patent Application No. 10-2020-0148579, filed in the Republic of Korea on Nov. 9, 2020, the entire contents of which is hereby expressly incorporated by reference for all purposes as if fully set forth herein into the present application.

BACKGROUND

Technical Field

The present disclosure relates to a display device and a driving circuit.

Discussion of the Related Art

As the information society develops, a demand for display devices displaying images is increasing in various forms. Various types of display devices such as a liquid crystal display device and an organic light emitting display device have been used for this purpose.

Among such display devices, the organic light emitting display device utilizes an organic light emitting diode emitting light by itself, so that there can have advantages in the rapid response speed, contrast ratio, luminous efficiency, luminance and viewing angle.

Such a display device can include light emitting elements disposed in each of a plurality of subpixels arranged on a display panel, so that it is possible to control the luminance displayed in each subpixel and display the image by controlling the voltage or current flowing through the light emitting element to emit light.

Transistors are disposed in each subpixel defined in the display panel, and a driving characteristic value of the transistor in each subpixel can change according to a driving time, or a deviation in a driving characteristic value of the transistor can occur between the subpixels. Alternatively, in the case of an organic light emitting display device, a deviation in deterioration can occur between organic light emitting diodes in the subpixels. This phenomenon can cause luminance non-uniformity between the subpixels, thereby deteriorating image quality.

Accordingly, in order to address the luminance non-uniformity between subpixels, a pixel compensation technology has been proposed to compensate for a change or deviation of a driving characteristic value of an element (e.g., a transistor or an organic light emitting diode) in a circuit.

Such pixel compensation is a technique used for preventing or reducing luminance non-uniformity of subpixels by sensing a specific node of a circuit in a subpixel and using the sensing result to change data supplied to each subpixel.

However, despite the provision of such a pixel compensation function, there can be still a phenomenon in which the luminance compensation of the subpixels or the luminance deviation compensation between each subpixel is not properly performed.

In particular, in the process of sequentially detecting a sensing channel to detect a driving characteristic value, there can be a limitation in which a compensation offset deviation occurs due to a temperature change according to a sensing time, and thus, stripes due to the compensation deviation can occur.

SUMMARY OF THE DISCLOSURE

Embodiments of the present disclosure can provide a display device and a driving circuit capable of reducing the compensation offset for the driving characteristic value of the display panel.

In addition, embodiments of the present disclosure can provide a display device and a driving circuit capable of reducing compensation offset by making the number of times of detecting the dummy sensing voltage through the dummy channel more than the number of detecting the sensing voltage through the sensing channel.

Further, embodiments of the present disclosure can provide a display device and a driving circuit capable of reducing offset noise by accumulating a dummy sensing voltage repeatedly detected through a dummy channel.

In one aspect, embodiments of the present disclosure can provide a display device including a display panel having a plurality of subpixels and a plurality of sensing channels connected to the plurality of subpixels to detect a driving characteristic value, a data driving circuit including an analog-to-digital converter converting sensing voltages detected from the plurality of sensing channels into digital sensing data, in which at least one dummy channel applying a driving voltage-for-sensing to detect a characteristic value of the analog-to-digital converter is connected to the analog-to-digital converter, and a timing controller for receiving offset data detected in the at least one dummy channel from the analog-to-digital converter and compensating for the characteristic value of the analog-to-digital converter.

In one aspect, the driving characteristic value can be a value representing a threshold voltage or mobility of a driving transistor constituting the subpixel.

In one aspect, the plurality of sensing channels can be signal lines to which a reference voltage is applied to the plurality of subpixels.

In one aspect, the data driving circuit can detect the sensing voltage by initializing the plurality of sensing channels to the reference voltage, tracking voltage changes for the plurality of sensing channels, and sampling the sensing voltage charged in the plurality of sensing channels after a predetermined time.

In one aspect, the at least one dummy channel can be disposed outside the plurality of sensing channels, or can be disposed between the plurality of sensing channels.

In one aspect, the data driving circuit can detect the characteristic value of the analog-to-digital converter through an off-sensing process performed in a state in which a power-off signal is generated and a data voltage is cut off.

In one aspect, the driving voltage-for-sensing can be an off-sensing driving voltage.

In one aspect, while the digital sensing data is generated once from the plurality of sensing channels, the offset data can be generated two or more times from the at least one dummy channel.

In one aspect, the offset data generated two or more times can be sequentially output during a period in which the digital sensing data is generated once.

In one aspect, the timing controller can compensate the characteristic value of the analog-to-digital converter by comparing the offset data with a reference value stored in a memory.

In one aspect, the timing controller can reduce a characteristic value deviation of the analog-to-digital converter by summing the offset data two or more times transmitted from the data driving circuit to calculate an average value.

In one aspect, the timing controller can further include a subpixel compensation circuit for compensating the driving characteristic value by generating compensated digital image data from the digital sensing data and supplying the compensated digital image data to a corresponding subpixel.

In another aspect, embodiments of the present disclosure can provide a driving circuit including a plurality of data lines extending to a display panel on which a plurality of subpixels are disposed to supply a data voltage, an analog-to-digital converter converting a driving characteristic value detected from a plurality of sensing channels connected to the plurality of subpixels into digital sensing data, and at least one dummy channel connected to the analog-to-digital converter for applying a driving voltage-for-sensing to detect a characteristic value of the analog-to-digital converter.

In another aspect, the analog-to-digital converter can output the digital sensing data, and offset data detected from the at least one dummy channel.

According to embodiments of the present disclosure, it is possible to provide a display device and a driving circuit capable of reducing the compensation offset for the driving characteristic value of the display panel.

In addition, according to embodiments of the present disclosure, it is possible to provide a display device and a driving circuit capable of reducing compensation offset by making the number of times of detecting the dummy sensing voltage through the dummy channel more than the number of detecting the sensing voltage through the sensing channel.

Further, according to embodiments of the present disclosure, it is possible to provide a display device and a driving circuit capable of reducing offset noise by accumulating a dummy sensing voltage repeatedly detected through a dummy channel.

BRIEF DESCRIPTION OF THE DRAWINGS

The present disclosure will become more fully understood from the detailed description given hereinbelow and the accompanying drawings which are given by way of illustration only, and thus are not limitative of the present disclosure.

DETAILED DESCRIPTION OF THE EMBODIMENTS

Figure 1:
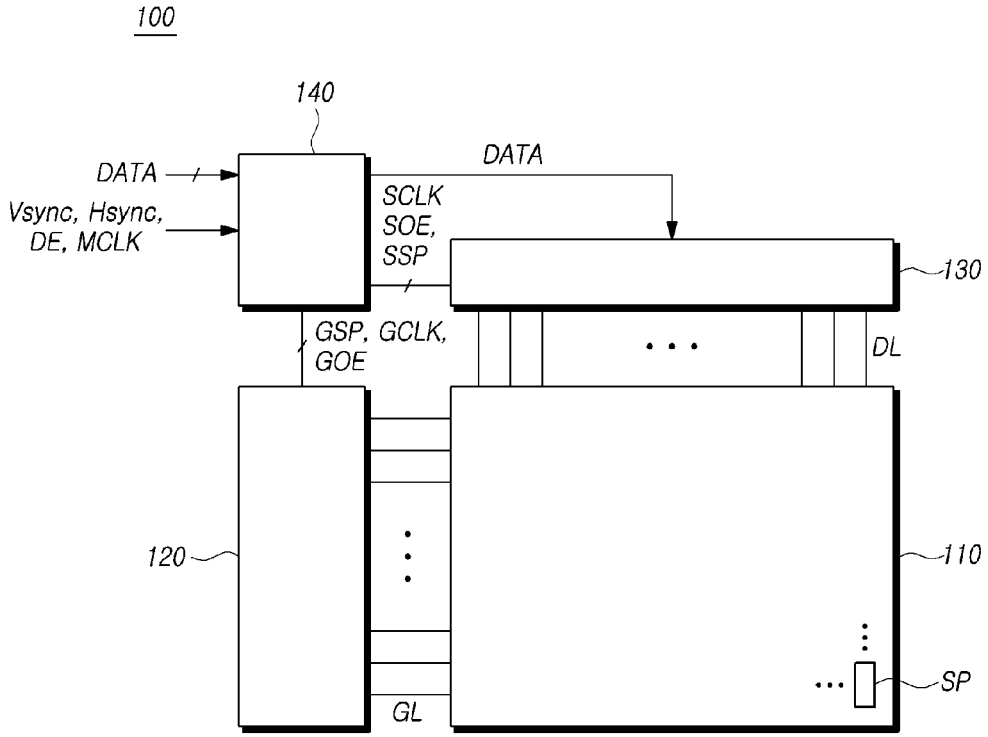
FIG. 1 illustrates a schematic configuration of a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description can make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can".

FIG. 1 illustrates a schematic configuration of a display device according to embodiments of the present disclosure. All the components of each display device according to all embodiments of the present disclosure are operatively coupled and configured.

Referring to FIG. 1, a display device 100 according to the embodiments of the present disclosure can include a display panel 110 in which a plurality of gate lines GL and data lines DL are connected, and a plurality of subpixels SP are arranged in a matrix form, a gate driving circuit 120 for driving the plurality of gate lines GL, a data driving circuit 130 for supplying a data voltage through the plurality of data lines DL, and a timing controller 140 that controls the gate driving circuit 120 and the data driving circuit 130.

The display panel 110 can display the image based on a scan signal transmitted from the gate driving circuit 120 through the plurality of gate lines GL and a data voltage transmitted from the data driving circuit 130 through the plurality of data lines DL.

In the case of a liquid crystal display, the display panel 110 includes a liquid crystal layer formed between two substrates, and can be operated in any known mode such as twisted nematic (TN) mode, vertical alignment (VA) mode, in-plane switching (IPS) mode, fringe field switching (FFS) mode. On the other hand, in the case of an organic light emitting display, the display panel 110 can be implemented in a top emission method, a bottom emission method, or a dual emission method.

In the display panel 110, a plurality of pixels can be arranged in a matrix form, and each pixel can composed of one or more of subpixels SP each having a different color, for example, a white (W) subpixel, a red (R) subpixel, a green (G) subpixel, and a blue (B) subpixels, and each subpixel SP can be defined by a plurality of data lines DL and a plurality of gate lines GL.

Each subpixel SP can include a thin film transistor (TFT) formed in a region where one data line DL and one gate line GL intersect, a light emitting element such as an organic light emitting diode for charging the data voltage, and a storage capacitor for maintaining a voltage by being electrically connected to the light emitting element.

For example, in the case of the WRGB display device 100 having a resolution of 2,160×3,840, the 2,160 gate lines GL and all 3,840×4=15,360 data lines DL can be provided by 3,840 data lines DL respectively connected to the four subpixels WRGB, and subpixels SP can be disposed at points where these gate lines GL and data lines DL intersect with each other.

The gate driving circuit 120 can be controlled by the timing controller 140, and can sequentially output scan signals to a plurality of gate lines GL disposed on the display panel 110, so as to control driving timing for a plurality of subpixels SP.

In the display device 100 having a resolution of 2,160×3,840, a case in which scan signals are sequentially output from the first gate line to the 2,160th gate line for 2,160 gate lines GL can be referred to as 2,160 phase driving. Alternatively, a case in which scan signals are sequentially outputted in units of four gate lines GL, such as a case of sequentially outputting scan signals from the first gate line to the fourth gate line and then sequentially outputting the scan signals from the fifth gate line to the eighth gate line, can be referred to as 4 phase driving. For example, a case in which scan signals are sequentially output for every N gate lines GL can be referred to as N-phase driving.

In this case, the gate driving circuit 120 can include one or more gate driving integrated circuits (GDIC), and can be located on only one side or both/multiple sides of the display panel 110 according to a driving method. Alternatively, the gate driving circuit 120 can be embedded in a bezel area of the display panel 110 and implemented in a GIP (Gate-in-panel) form.

The data driving circuit 130 receives digital image data DATA from the timing controller 140, converts the digital image data into an analog data voltage. The data driving circuit 130 then outputs the data voltage to each data line DL according to the timing at which the scan signal is applied through the gate line GL, so that each subpixel SP connected to the data line DL displays a light emission signal of brightness corresponding to the data voltage.

Similarly, The data driving circuit 130 can include one or more source driving integrated circuits (SDIC), and the source driving integrated circuit (SDIC) can be connected to a bonding pad of the display panel 110 in a TAB (Tape Automated Bonding) method or a COG (Chip-on-glass) method, or can be directly disposed on the display panel 110.

In some cases, each source driving integrated circuit (SDIC) can be integrated and disposed on the display panel 110. In addition, each source driving integrated circuit (SDIC) can be implemented in a COF (Chip-on-film) method. In this case, each source driving integrated circuit (SDIC) can be mounted on a circuit film, and can be electrically connected to the data line DL of the display panel 110.

The timing controller 140 can supply various control signals to the gate driving circuit 120 and the data driving circuit 130 and can control operations of the gate driving circuit 120 and the data driving circuit 130. For example, the timing controller 140 controls the gate driving circuit 120 to output the scan signal according to the timing implemented in each frame, and transfers the digital image data DATA received from the outside to the data driving circuit 130.

In this case, the timing controller 140 can receive various timing signals including a vertical synchronization signal Vsync, a horizontal synchronization signal Hsync, a data enable signal DE, a main clock signal MCLK together with digital image data DATA from an external (e.g., host system). Accordingly, the timing controller 140 can generate a control signal using various timing signals received from the outside, and can transmit the control signal to the gate driving circuit 120 and the data driving circuit 130.

For example, in order to control the gate driving circuit 120, the timing controller 140 can output a plurality of gate control signal including a gate start pulse signal GSP, a gate clock GCLK, and a gate output enable signal GOE. Here, the gate start pulse signal GSP controls the timing at which one or more gate driving integrated circuits (GDIC) constituting the gate driving circuit 120 start to operate. In addition, the gate clock GCLK is a clock signal commonly input to one or more gate driving integrated circuits GDIC, and controls shift timing of the scan signal. In addition, the gate output enable signal GOE designates timing information of one or more gate driving integrated circuits (GDIC).

In addition, in order to control the data driving circuit 130, the timing controller can output a plurality of data control signals including a source start pulse SSP, a source sampling clock SCLK, and a source output enable signal SOE. Here, the source start pulse SSP controls the timing at which one or more source driving integrated circuits (SDIC) constituting the data driving circuit 130 start data sampling. The source sampling clock SCLK is a clock signal that controls the timing of sampling data in the source driving integrated circuit (SDIC). The source output enable signal SOE controls the output timing of the data driving circuit 130.

The display device 100 can further include a power management integrated circuit that supplies various voltages or currents to the display panel 110, the gate driving circuit 120, the data driving circuit 130, or the like, or controls various voltages or currents to be supplied.

Meanwhile, as mentioned above, the subpixel SP is located at a region where the gate line GL and the data line DL cross each other, and a light emitting element can be disposed in each subpixel SP. For example, the organic light emitting display device includes a light emitting element such as an organic light emitting diode in each subpixel SP, and can display an image by controlling a current flowing through the light emitting element according to a data voltage.

The display device 100 can be any one among the various types of devices such as a liquid crystal display, an organic light emitting display, and a plasma display panel.

Figure 2:
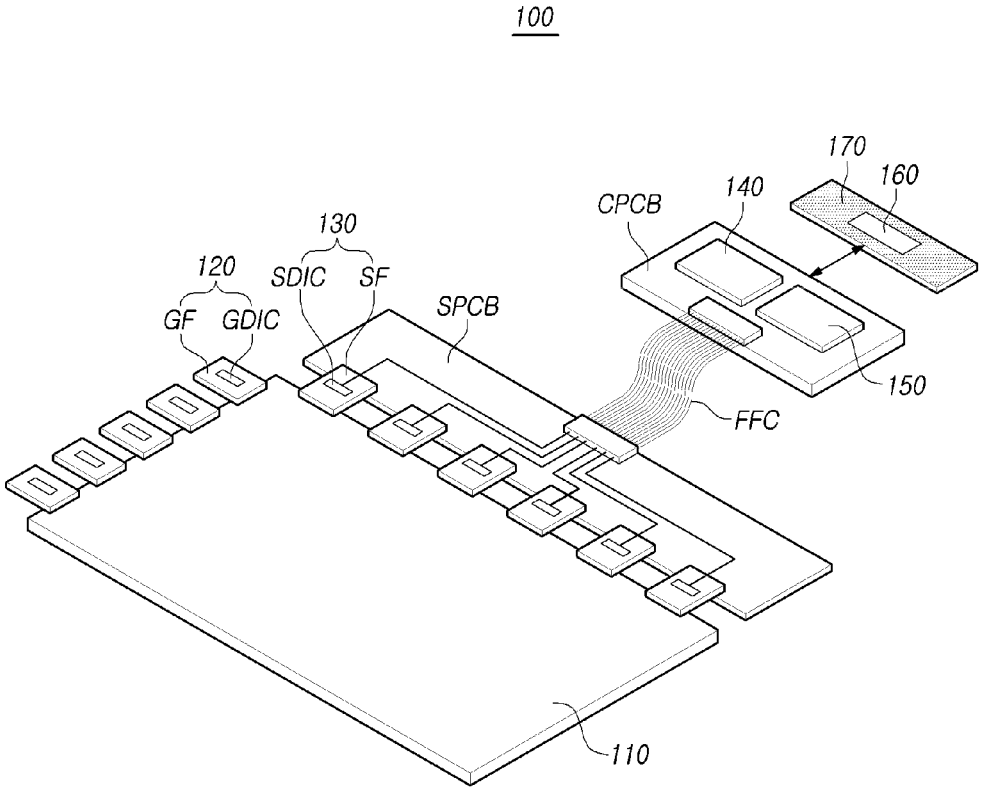
FIG. 2 is an exemplary system diagram of a display device according to embodiments of the present disclosure.

FIG. 2 is an exemplary system diagram of a display device according to embodiments of the present disclosure.

FIG. 2 illustrates the case in which, in the display device 100 according to the exemplary embodiment of the present disclosure, the source driving integrated circuit SDIC included in the data driving circuit 130 is implemented in a chip-on-film (COF) method among various methods (TAB, COG, COF, etc.), and the gate driving circuit 120 is implemented in a gate-in-panel (GIP) method among various methods (TAB, COG, COF, GIP, etc.)

At least one gate driving integrated circuit GDIC included in the gate driving circuit 120 can be mounted on the gate film GF, respectively, and one side of the gate film GF can be electrically connected to the display panel 110. Also, lines for electrically connecting the gate driving integrated circuit GDIC and the display panel 110 can be disposed on the gate film GF.

Similarly, at least one source driving integrated circuit SDIC included in the data driving circuit 130 can be mounted on each source film SF, and one side of the source film SF can be electrically connected to the display panel 110. Also, lines for electrically connecting the source driving integrated circuit SDIC and the display panel 110 can be disposed on the source film SF.

The display device 100 can include at least one source printed circuit board SPCB and a control printed circuit board CPCB for mounting control components and various electric devices in order to connect a plurality of source driving integrated circuits SDIC and other devices.

In this case, the side of the source film SF other than the side on which the source driving integrated circuit SDIC is mounted can be connected to the at least one source printed circuit board SPCB. For example, one side of the source film SF on which the source driving integrated circuit SDIC is mounted can be electrically connected to the display panel 110, and the other side thereof can be electrically connected to the source printed circuit board SPCB.

A timing controller 140 and a power management integrated circuit (PMIC) 150 can be mounted on the control printed circuit board CPCB. The timing controller 140 can control operations of the data driving circuit 130 and the gate driving circuit 120. The power management integrated circuit 150 can supply a driving voltage or current to the display panel 110, the data driving circuit 130, the gate driving circuit 120, and the like, and can control the supplied voltage or current.

At least one source printed circuit board SPCB and a control printed circuit board CPCB can be circuitry connected through at least one connection member, and the connection member can include, for example, a flexible printed circuit (FPC), a flexible flat cable (FFC), or the like. In addition, at least one of the source printed circuit board SPCB and the control printed circuit board CPCB can be implemented by being integrated into one printed circuit board.

The display device 100 can further include a set board 170 electrically connected to a control printed circuit board CPCB. In this case, the set board 170 can be referred to as a power board. The set board 170 can include a main power management circuit M-PMC 160 that manages the total power of the display device 100. The main power management circuit 160 can be linked with the power management integrated circuit 150.

In the case of the display device 100 having the above configuration, the driving voltage can be generated at the set board 170 and transmitted to the power management integrated circuit 150 in the control printed circuit board CPCB. The power management integrated circuit 150 can transmit the driving voltage required for driving a display or sensing a characteristic value to a source printed circuit board SPCB through a flexible printed circuit (FPC) or a flexible flat cable (FFC). The driving voltage transmitted to the source printed circuit board SPCB can be supplied to emit or sense a specific subpixel SP in the display panel 110 through the source driving integrated circuit SDIC.

In this case, each of the subpixels SP arranged on the display panel 110 in the display device 100 can include an organic light emitting diode, which is a light emitting element, and a circuit element such as a driving transistor for driving the subpixel SP.

The type and number of circuit elements constituting each subpixel SP can be variously determined according to a provision function and a design method.

Figure 3:
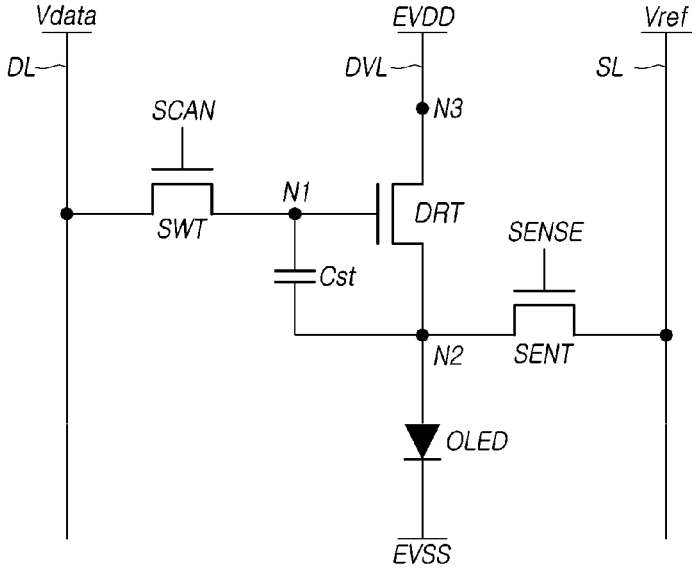
FIG. 3 is an exemplary diagram of a circuit constituting a subpixel in a display device according to embodiments of the present disclosure.

FIG. 3 is an exemplary diagram of a circuit constituting a subpixel in a display device according to exemplary embodiments of the present disclosure.

Referring to FIG. 3, in the display device 100 according to exemplary embodiments, each subpixel SP can include one or more transistors and a capacitor, and an organic light emitting diode OLED can be disposed as the light emitting element.

For example, the subpixel SP can include a driving transistor DRT, a switching transistor SWT, a sensing transistor SENT, a storage capacitor Cst, and aT organic light emitting element OLED.

The driving transistor DRT has a first node N1, a second node N2, and a third node N3. The first node N1 of the driving transistor DRT can be a gate node to which the data voltage Vdata is applied through the data line DL when the switching transistor SWT is turned on. The second node N2 of the driving transistor DRT can be electrically connected to an anode electrode of the organic light emitting diode OLED, and can be a source node or a drain node. The third node N3 of the driving transistor DRT is electrically connected to the driving voltage line DVL to which the driving voltage EVDD is applied, and can be a drain node or a source node.

Here, during the display driving period, the driving voltage EVDD required for driving the display can be supplied to the driving voltage line DVL. For example, the driving voltage EVDD required for driving the display can be 27V.

The switching transistor SWT is electrically connected between the first node N1 of the driving transistor DRT and the data line DL, and operates according to a scan signal SCAN supplied by the gate line GL connected to the gate node. In addition, when the switching transistor SWT is turned on, the operation of the driving transistor DRT is controlled by transferring the data voltage Vdata supplied through the data line DL to the gate node of the driving transistor DRT.

The sensing transistor SENT is electrically connected between the second node N2 of the driving transistor DRT and a sensing line SL, and operates according to a scan signal SCAN supplied by the gate line GL connected to the gate node. When the sensing transistor SENT is turned on, a sensing reference voltage Vref supplied through the sensing line SL is transmitted to the second node N2 of the driving transistor DRT.

For example, by controlling the switching transistor SWT and the sensing transistor SENT, the voltage of the first node N1 and the voltage of the second node N2 of the driving transistor DRT are controlled, so that the driving current for driving the organic light emitting diode OLED can be supplied.

The switching transistor SWT and the sensing transistor SENT can be connected to the single gate line GL or to different gate lines GL. Here, it is illustrated an exemplary structure in which the switching transistor SWT and the sensing transistor SENT are connected to different gate lines GL. In this case, the switching transistor SWT and the sensing transistor SENT can be independently controlled by the scan signal SCAN and a sense signal SENSE transmitted through different gate lines GL Meanwhile, in the case that the switching transistor SWT and the sensing transistor SENT are connected to one gate line GL, the switching transistor SWT and the sensing transistor SENT can be simultaneously controlled by the scan signal SCAN or the sense signal SENSE transmitted through one gate line GL, and the aperture ratio can be increased.

Meanwhile, the transistor disposed in the subpixel SP can be formed of not only an n-type transistor but also a p-type transistor. Here, a case of an n-type transistor is illustrated as an example.

The storage capacitor Cst is electrically connected between the first node N1 and the second node N2 of the driving transistor DRT, and maintains the data voltage Vdata for one frame.

The storage capacitor Cst can be connected between the first node N1 and the third node N3 of the driving transistor DRT according to the type of the driving transistor DRT. The anode electrode of the organic light emitting diode OLED can be electrically connected to the second node N2 of the driving transistor DRT, and a base voltage EVSS can be supplied to the cathode electrode of the organic light emitting diode OLED.

Here, the base voltage EVSS can be a ground voltage or a voltage higher or lower than the ground voltage. Further, the base voltage EVSS can vary according to the driving state. For example, the base voltage EVSS at the time of driving the image and the base voltage EVSS at the time of driving the sensing can be set differently from each other.

The structure of the subpixel SP described as an example above can be a 3T (Transistor) 1C (Capacitor) structure, and is only an example for explanation, and can further include one or more transistors, or in some cases, can further include one or more capacitors. Alternatively, each of the plurality of subpixels SP can have the same structure, and some of the plurality of subpixels SP can have a different structure.

In order to effectively sense a characteristic value of the driving transistor DRT, for example, a threshold voltage or mobility in the display device 100 according to the exemplary embodiments of the present disclosure, there can be used a method of measuring the current flowing by the voltage charged in the storage capacitor Cst during the sensing period of the characteristic value of the driving transistor DRT which can be referred as a current sensing.

For example, by measuring the current flowing by the voltage charged in the storage capacitor Cst during the sensing period of the characteristic value of the driving transistor DRT, the characteristic value or the change in the characteristic value of the driving transistor DRT in the subpixel SP can be detected.

In this case, the sensing line SL not only serves to transmit the reference voltage Vref, but also serves to sense a driving characteristic value of the driving transistor DRT in the subpixel SP.

As described above, the period for sensing the driving characteristic values (threshold voltage and mobility) of the driving transistor DRT can be performed after a power-on signal is generated and before the display driving starts. For example, when the power-on signal is applied to the display device 100, the timing controller 140 loads parameters necessary for driving the display panel 110 and then drives the display. In this case, the parameters needed to drive the display panel 110 can include information on sensing and compensation of driving characteristic values previously performed in the display panel 110. During the parameter loading process, the driving characteristic values (threshold voltage and mobility) of the driving transistor DRT can be sensed. As described above, a process for sensing the driving characteristic value during the parameter loading process after the power-on signal is generated can be referred to as an on-sensing process.

Meanwhile, a period for sensing the driving characteristic value of the driving transistor DRT can proceed after a power-off signal of the display device 100 is generated. For example, when the power-off signal is generated in the display device 100, the timing controller 140 can cut off the data voltage supplied to the display panel 110 and can sense the driving characteristic value of the driving transistor DRT for a predetermined time. In this way, a process for sensing the driving characteristic value during a state in which a power-off signal is generated and the data voltage is cut off can be referred to as an off-sensing process.

In addition, the sensing period for the driving characteristic value of the driving transistor DRT can be performed in real time while the display is being driven. This sensing process is called a real-time (RT) sensing process. In the case of the real-time sensing process, a sensing process can be performed on one or more subpixels SP in one or more subpixel lines for each blank period during the display driving period.

For example, during the display driving period in which an image is displayed on the display panel 110, there can exist a blank period in which the data voltage is not supplied to the subpixel SP within one frame or between the n-th frame and the (n+1)th frame. In such a blank period, the mobility of one or more subpixels SP can be sensed.

As described above, if the sensing process is performed in the blank period, the subpixel SP line for performing the sensing process can be randomly selected. Accordingly, after performing the sensing process in the blank period, the occurrence of any abnormality in the display driving period can be alleviated. In addition, after performing the sensing process during the blank period, the compensation data voltage can be supplied to the subpixel SP on which the sensing process was performed during the display driving period. Accordingly, it can further alleviate the occurrence of the abnormality in the subpixel SP line for which the sensing process is completed in the display driving period after the sensing process in the blank period.

Meanwhile, the data driving circuit 130 can include a data voltage output circuit including a latch circuit, a digital-to-analog converter (DAC) and an output buffer (BUF), and, in some cases, can further include an analog-to-digital converter (ADC) and various switches (SAM, SPRE, RPRE). On the other hand, the analog-to-digital converter (ADC) and various switches (SAM, SPRE, RPRE) can be located outside the data driving circuit 130.

In addition, a compensation circuit 142 (e.g., see FIG. 4) can exist outside the timing controller 140, but can be included inside the timing controller 140. In addition, a memory 146 (e.g., see FIG. 4) can be located outside the timing controller 140, or can be implemented in the form of a register inside the timing controller 140.

Figure 4:
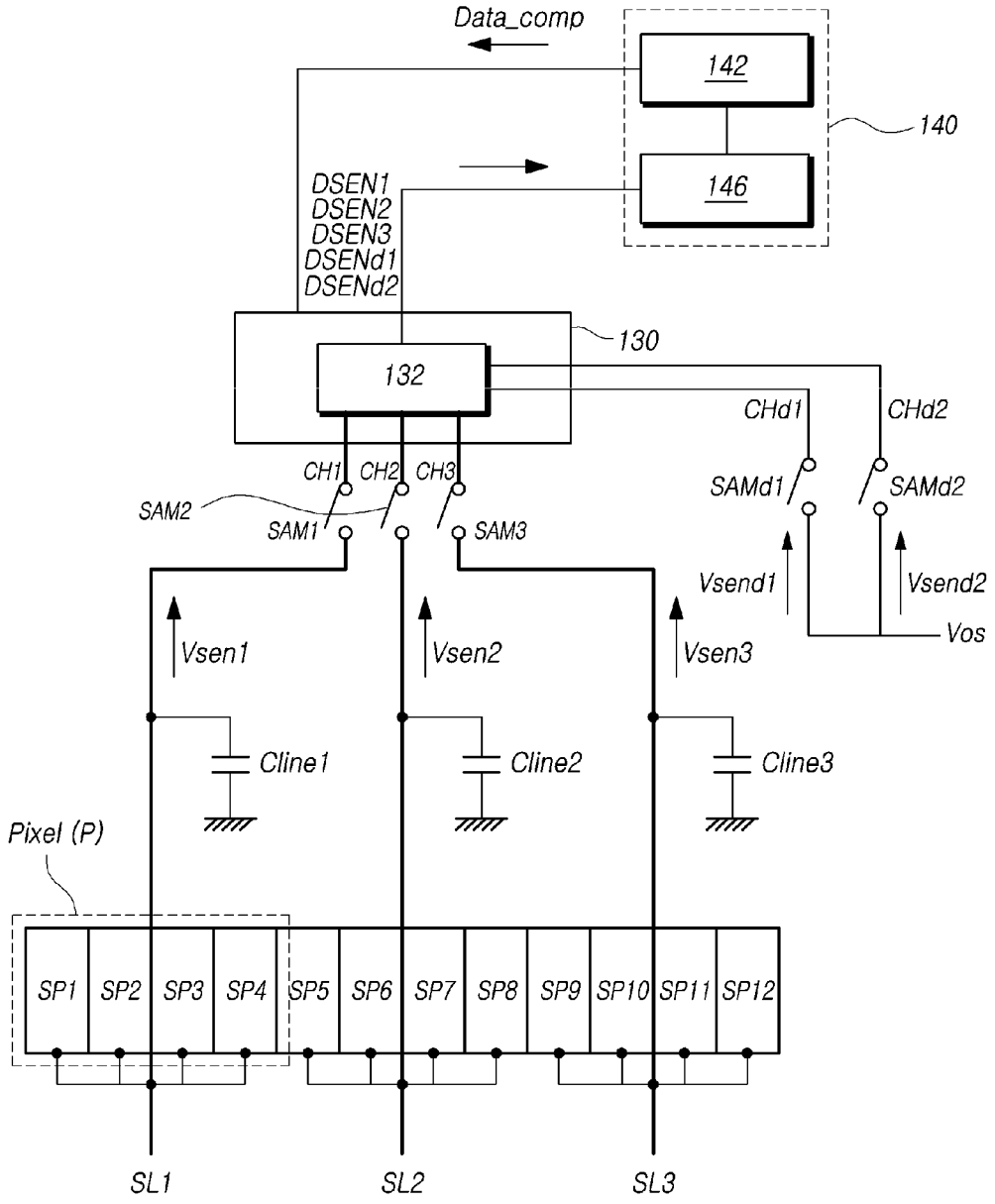
FIG. 4 is a diagram for illustratively explaining compensation for driving characteristic values and compensation for offset values in a display device according to embodiments of the present disclosure.

FIG. 4 is a diagram for illustratively explaining compensation for driving characteristic values and compensation for offset values in a display device according to embodiments of the present disclosure.

Referring to FIG. 4, in the display device 100 according to the embodiments of the present disclosure, one analog-to-digital converter 132 can include three sensing channels CH1, CH2, CH3 and two dummy channels CHd1, CHd2.

The three sensing channels CH1, CH2, CH3 can be connected in correspondence with three sensing lines SL1, SL2, SL3 through a sampling switch SAM1, SAM2, SAM3, respectively, and each of the three sensing lines SL1, SL2, SL3 can be connected to the four subpixels SP. For example, a first sensing line SL1 corresponding to a first sensing channel CH1 can be shared and connected to the first to fourth subpixels SP1, SP2, SP3, SP4.

Similarly, a second sensing line SL2 corresponding to a second sensing channel CH2 can be shared and connected to the fifth to eighth subpixels SP5, SP6, SP7, SP8, and a third sensing line SL3 corresponding to a third sensing channel CH3 can be shared and connected to the ninth to twelfth subpixels SP9, SP10, SP11, SP12.

For example, four subpixels SP constitute one pixel P. For example, the four subpixels SP can include a red subpixel R, a white subpixel W, a green subpixel G, and a blue subpixel B. For example, the first subpixel SP1, the fifth subpixel SP5 and the ninth subpixel SP9 can be the red subpixel R, the second subpixel SP2, the sixth subpixel SP6 and the tenth subpixel SP10 can be the white subpixel W, the third subpixel SP3, the seventh subpixel SP7 and the eleventh subpixel SP11 can be the green subpixel G, and the fourth subpixel SP4, the eighth subpixel SP8 and the twelfth subpixel SP12 can be the blue subpixel B.

Meanwhile, the two dummy channels CHd1, CHd2 can be connected to an off-sensing voltage Vos corresponding to a sensing driving voltage to detect a characteristic value of the analog-to-digital converter 132 through dummy sampling switches SAMd1, SAMd2, respectively. In this case, since the two dummy channels CHd1, CHd2 are not connected to the subpixels constituting the display panel 110, the dummy sensing voltages Vsend1 and Vsend2 detected through the dummy channels CHd1, CHd2 do not represent the driving characteristic values of the subpixels, and can be used to compensate for a gain or offset of the analog-to-digital converter 132.

At a first time point, the analog-to-digital converter 132 can detect a sensing voltage Vsen1 for one subpixel (for example, SP1) among four subpixels SP1, SP2, SP3, SP4 connected to the first sensing line SL1. Similarly, the analog-to-digital converter 132 can detect a sensing voltage Vsen2 for one subpixel (for example, SP5) among the four subpixels SP5, SP6, SP7, SP8 connected to the second sensing line SL2, and can detect a sensing voltage Vsen3 for one subpixel (for example, SP9) among the four subpixels SP9, SP10, SP11, SP12 connected to the third sensing line SL3.

At a second time point after the first time point, the analog-to-digital converter 132 can detect a sensing voltage Vsen1 for the other subpixel (e.g., SP2) among the four subpixels SP1, SP2, SP3, SP4 connected to the first sensing line SL1. Similarly, the analog-to-digital converter 132 can detect a sensing voltage Vsen2 for the other subpixel (e.g., SP6) among the four subpixels SP5, SP6, SP7, SP8 connected to the second sensing line SL2, and can detect a sensing voltage Vsen3 for the other subpixel (e.g., SP10) among the four subpixels SP9, SP10, SP11, SP12 connected to the third sensing line SL3.

In this case, the analog-to-digital converter 132 can control the sampling switch SAM1, SAM2, SAM3 so as to simultaneously detect the sensing voltages Vsen for the three subpixels through each of the three sensing lines SL1, SL2, SL3 at one time point, or can detect them individually.

For example, at the first time point, the analog-to-digital converter 132 can turn on the sampling switches SAM1, SAM2, SAM3 at the same time, so that the sensing voltages Vsen1, Vsen2, Vsen3 for the first subpixel SP1, the fifth subpixel SP5 and the ninth subpixel SP9 corresponding to the red subpixel R can be detected simultaneously through the first sensing line SL1, the second sensing line SL2 and the third sensing line SL3, respectively.

In addition, at the second time point, the analog-to-digital converter 132 can turn on the sampling switches SAM1, SAM2, SAM3 at the same time, so that the sensing voltages Vsen1, Vsen2, Vsen3 for the second subpixel SP2, the sixth subpixel SP6 and the tenth subpixel SP10 corresponding to the white subpixel W can be detected simultaneously through the first sensing line SL1, the second sensing line SL2 and the third sensing line SL3, respectively.

In addition, at the third time point, the analog-to-digital converter 132 can turn on the sampling switches SAM1, SAM2, SAM3 at the same time, so that the sensing voltages Vsen1, Vsen2, Vsen3 for the third subpixel SP3, the seventh subpixel SP7 and the eleventh subpixel SP11 corresponding to the green subpixel G can be detected simultaneously through the first sensing line SL1, the second sensing line SL2 and the third sensing line SL3, respectively.

In addition, at the fourth time point, the analog-to-digital converter 132 can turn on the sampling switches SAM1, SAM2, SAM3 at the same time, so that the sensing voltages Vsen1, Vsen2, Vsen3 for the fourth subpixel SP4, the eighth subpixel SP8 and the twelfth subpixel SP12 corresponding to the blue subpixel B can be detected simultaneously through the first sensing line SL1, the second sensing line SL2 and the third sensing line SL3, respectively.

In this case, line capacitors Cline1, Cline2, Cline3 can be connected to each of the three sensing lines SL1, SL2, SL3 to store the sensing voltage Vsen for a sensing node of a corresponding subpixel. In other words, the sensing voltage Vsen1 for a subpixel detected among the four subpixels SP1, SP2, SP3, SP4 connected to the first sensing line SL1 can be stored in the first line capacitor Cline1 connected to the first sensing line SL1. In addition, the sensing voltage Vsen2 for a subpixel detected among the four subpixels SP5, SP6, SP7, SP8 connected to the second sensing line SL2 can be stored in the second line capacitor Cline2 connected to the second sensing line SL2, and the sensing voltage Vsen3 for a subpixel detected among the four subpixels SP9, SP10, SP11, SP12 connected to the third sensing line SL3 can be stored in the third line capacitor Cline3 connected to the third sensing line SL3.

Accordingly, the analog-to-digital converter 132 can detect the sensing voltages Vsen1, Vsen2, Vsen3 stored in the three line capacitors Cline1, Cline2, Cline3 at the same time or separately, so as to measure three sensing voltages Vsen1, Vsen2, Vsen3 through three sensing channels CH1, CH2, CH3.

In addition, the analog-to-digital converter 132 can control dummy sampling switches SAMd1, SAMd2 in the off-sensing process, so as to detect simultaneously or individually the dummy sensing voltages Vsend1, Vsend2 for the dummy channels CHd1, CHd2 connected to the off-sensing voltage Vos.

Therefore, the analog-to-digital converter 132 can convert the data voltages Vsen1, Vsen2, Vsen3 detected through the three sensing channels CH1, CH2, CH3 into digital sensing data DSEN1, DSEN2, DSEN3. In addition, the analog-to-digital converter 132 can convert and output the dummy sensing voltages Vsend1, Vsend2 detected through the two dummy channels CHd1, CHd2 into digital dummy sensing data DSENd1, DSENd2, and the timing controller 140 can store them to the memory 146.

In this case, the compensation circuit 142 can read the digital sensing data DSEN1, DSEN2, DSEN3 transmitted from the sensing channels CH1, CH2, CH3, and can compensate digital image data DATA to be supplied to the subpixels and output the compensated digital image data DATA comp to the data driving circuit 130. In addition, the compensation circuit 142 can detect a gain or offset of the analog-to-digital converter 132 from the digital dummy sensing data DSENd1, DSENd2 transmitted from the dummy channels CHd1 and CHd2, and can change a reference value stored in the memory 146 to compensate them.

Figure 5:
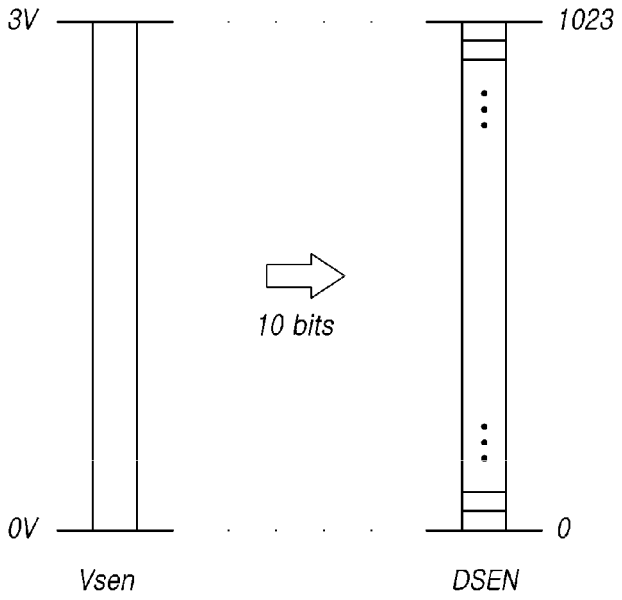
FIG. 5 illustrates a range of an input voltage and a range of an output data for an analog-to-digital converter constituting a data driving circuit in a display device according to embodiments of the present disclosure.
Figure 6:
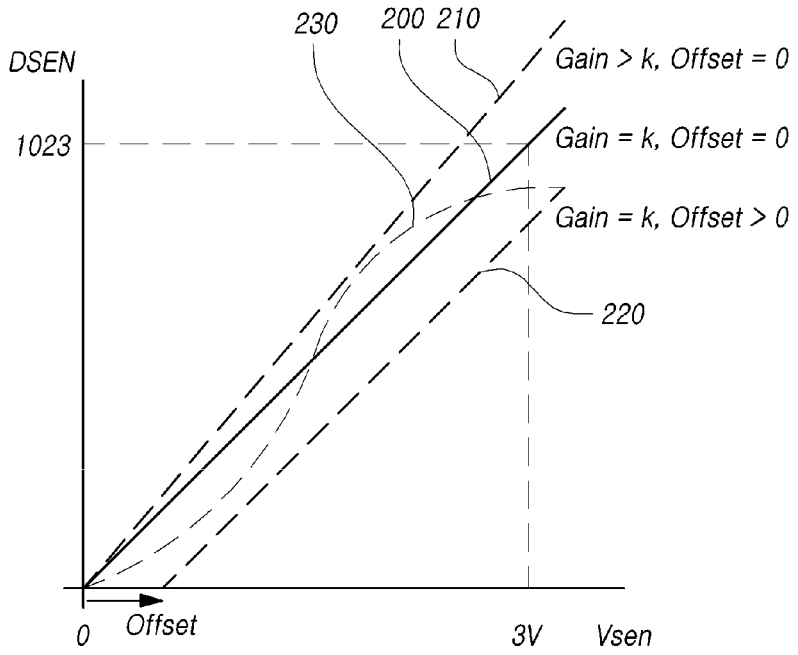
FIG. 6 is a graph illustrating input/output relationships of an analog-to-digital converter constituting a data driving circuit in a display device according to embodiments of the present disclosure.

FIG. 5 illustrates a range of an input voltage and a range of an output data for an analog-to-digital converter constituting a data driving circuit in a display device according to embodiments of the present disclosure, and FIG. 6 is a graph illustrating input/output relationships of an analog-to-digital converter constituting a data driving circuit in a display device according to embodiments of the present disclosure.

First, referring to FIG. 5, in the display device 100 according to the embodiments of the present disclosure, the range of a sensing voltage Vsen transmitted to the analog-to-digital converter 132 constituting the data driving circuit 130 can be 0 V to 3 V, and the range of the digital sensing data DSEN can be 0 to 1023 corresponding to 10 bits. For example, if the sensing voltage Vsen has a range within 0V to 3V, the range of digital sensing data DSEN that can be expressed in 10 bits can fall within 0 to 1023.

Referring to FIG. 6, the analog-to-digital converter 132 constituting the data driving circuit 130 can convert the analog sensing voltage Vsen detected through the sensing line SL into digital sensing data DSEN.

In an ideal case, the input/output relationship of the analog-to-digital converter 132 can be defined according to the straight line connecting a point (0, 0) where the sensing voltage Vsen is 0 V and digital sensing data DSEN is 0, and a point (3, 1023) where the sensing voltage Vsen is 3 V and the digital sensing data DSEN is 1023.

The ideal analog-to-digital converter 132 can be defined by a linear relationship in which a gain corresponding to a slope is k (=1023/3V) and an offset corresponding to an x-axis intercept is 0.

However, even if the analog-to-digital converter 132 has a linear characteristic, in reality, the analog-to-digital converter 132 can have a characteristic expressed as a straight line 210 where the gain corresponding to the slope is greater than k, or can have a linear characteristic expressed as a straight line where the gain corresponding to the slope is less than k.

In addition, the analog-to-digital converter 132 can have a linear characteristic expressed by a straight line 220 in which an offset corresponding to the x-axis intercept is greater than zero.

Alternatively, the analog-to-digital converter 132 may not have a linear characteristic but can have a non-linear characteristic according to the relationship between the sensing voltage Vsen and the digital sensing data DSEN.

The phenomenon in which the gain of the analog-to-digital converter 132 differs from the ideal gain (Gain=k) or the offset differs from the ideal offset (Offset=0) may occur due to internal factors, or external factors such as temperature changes.

For example, the characteristic value of the analog-to-digital converter 132 can be changed due to the external factors such as the analog-to-digital converter 132 or the data driving circuit 130 including the same, or the display device 100 operates for a long time, the temperature is high, or a high pressure is applied.

As described above, if the characteristic value of the analog-to-digital converter 132 is changed, the conversion characteristic can vary for each sensing channel CH1-CHn, or the conversion characteristic can vary between the analog-to-digital converters 132.

For example, in the case that the characteristic value of the analog-to-digital converter 132 is changed, a deviation may occur in the characteristics of the analog-to-digital converter 132, or in the characteristic between the sensing channels CH1-CHn.

In order to minimize the deviation of the characteristic value (gain or offset) of the analog-to-digital converter 132, the number of detections of the dummy sensing voltage Vsend through the dummy channels CHd1-CHdn can be greater than the number of detections of the sensing voltage Vsen through the sensing channels CH1-CHn so as to reduce the offset noise of the analog-to-digital converter 132. In other words, by accumulating the dummy sensing voltage Vsend repeatedly detected through the dummy channels CHd1-CHdn, the offset deviation of the analog-to-digital converter 132 can be reduced and offset noise can be reduced.

Figure 7:
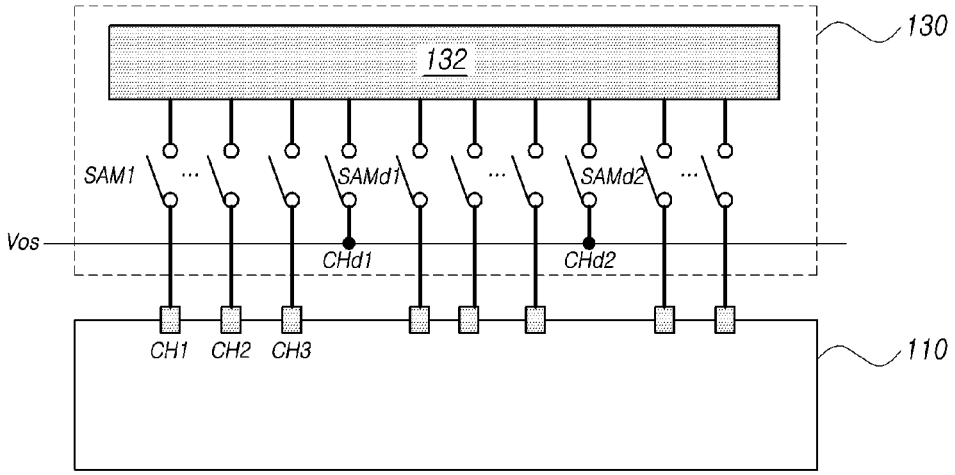
FIG. 7 illustrates an example of an arrangement structure of a sensing channel and a dummy channel in a display device according to embodiments of the present disclosure.
Figure 7:
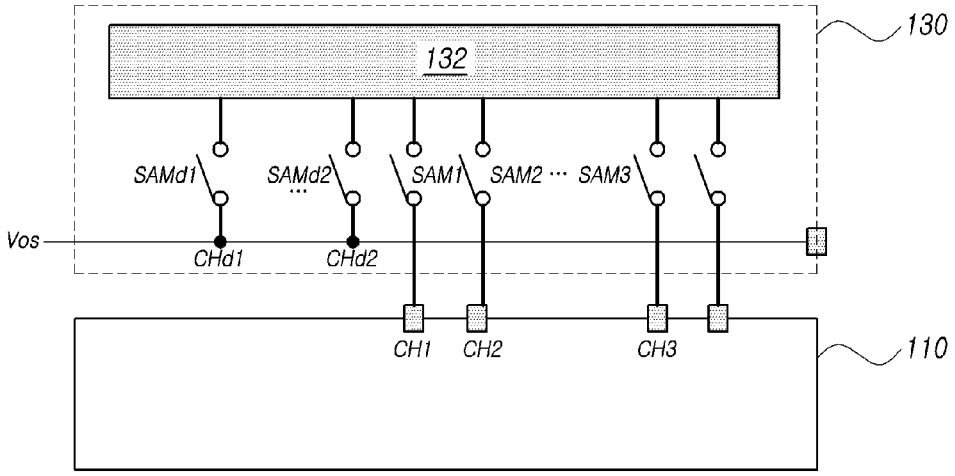

FIG. 7 illustrates an example of an arrangement structure of a sensing channel and a dummy channel in a display device according to embodiments of the present disclosure.

Referring to FIG. 7, in the display device 100 according to the embodiments of the present disclosure, one or more dummy channels CHd1, CHd2 to which the off-sensing voltage Vos is supplied can be disposed between sensing channels CH1, CH2, CH3 connected to subpixels constituting the display panel 110 (see (a) in FIG. 7). Alternatively, the dummy channels CHd1, CHd2 can be arranged in a row on the left or right side of the sensing channels CH1, CH2, CH3 (see (b) in FIG. 7).

Here, the sensing channels CH1, CH2, CH3 can be connected to the sensing line SL corresponding to the subpixel through the sampling switches SAM1, SAN2, SAM3, respectively, in order to detect the sensing voltage Vsen representing the driving characteristic value (threshold voltage or mobility) of the subpixel. The dummy channels CHd1, CHd2 are for compensating the gain or offset of the analog-to-digital converter 132, and the off-sensing voltage Vos can be applied through the dummy sampling switches SAMd1, SAMd2, respectively.

Figure 8:
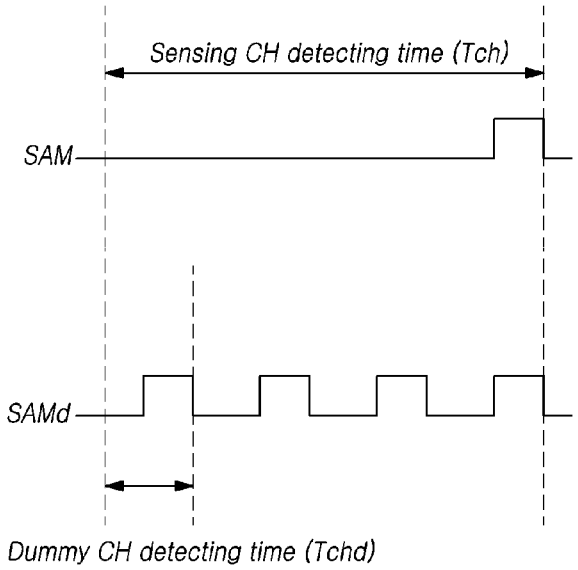
FIG. 8 schematically illustrates a sampling period for a sensing channel and a dummy channel in a display device according to embodiments of the present disclosure.

FIG. 8 schematically illustrates a sampling period for a sensing channel and a dummy channel in a display device according to embodiments of the present disclosure.

Referring to FIG. 8, in the display device 100 according to the embodiments of the present disclosure, the timing controller 140 can control an operation period of a sampling switch SAM located in the sensing channels CH1-CHn and a dummy sampling switch SAMd located in the dummy channels CHd1-CHdn.

Here, the sensing voltage Vsen of the sensing channel CH connected to the subpixel can be detected by a step of initializing the sensing line SL to a reference voltage, a step of tracking a voltage change of the sensing line SL, and a step of sampling the sensing voltage Vsen charged in the sensing line SL after a predetermined time.

In the step of initializing, the switching transistor SWT is in a turn-on state by the scan signal SCAN of the turn-on level, and the first node N1 of the driving transistor DRT is initialized to the data voltage Vdata. Further, the sensing transistor SENT is in a turn-on state by the sense signal SENSE of the turn-on level, and a sensing reference switch is turned on. In this state, the second node N2 of the driving transistor DRT is initialized to the reference voltage Vref.

The tracking step is a step of tracking the sensing voltage Vsen charged in the sensing line SL. In the tracking step, the scan signal SCAN of the turn-on level is maintained, and the sensing reference switch transits to the turn-off level. Accordingly, the second node N2 of the driving transistor DRT is floated, and the voltage of the second node N2 of the driving transistor DRT increases. In particular, since the voltage of the second node N2 of the driving transistor DRT is initialized to the reference voltage, it starts to rise from the reference voltage. At this time, since the sensing transistor SENT is turned on, an increase in the voltage of the second node N2 of the driving transistor DRT leads to an increase in the voltage of the sensing line SL.

In this case, the voltage increase of the second node N2 of the driving transistor DRT continues until the difference from the data voltage Vdata becomes as much as the threshold voltage. For example, when the voltage of the second node N2 of the driving transistor DRT differs from the data voltage Vdata by the threshold voltage, the voltage of the second node N2 of the driving transistor DRT is saturated.

In the sampling step, the sampling switch SAM is turned on when a predetermined time elapses from the time when the voltage of the second node N2 of the driving transistor DRT starts to rise. At this time, the analog-to-digital converter 132 can detect the voltage of the sensing line SL connected by the sampling switch SAM, for example, the sensing voltage Vsen formed at both ends of the line capacitor Cline, and can convert the sensing voltage Vsen into the digital sensing data DSEN.

As described above, since the tracking process is required until the second node N2 of the driving transistor DRT is saturated in a state in which the sensing line SL is initialized to the reference voltage in order to detect the sensing voltage Vsen for the sensing channel CH, it takes a relatively long time to detect the sensing voltage Vsen for the sensing channel CH. For example, the detecting time Tch of the sensing channel CH can take about 30 ms for the sampling switch SAM to operate in a state in which the sensing line SL is initialized with a reference voltage.

On the other hand, since the detection of the dummy sensing voltage Vsend for the dummy channel CHd can be performed only by the operation of turning off the dummy sampling switch SAMd without a separate tracking process in the state initialized to the off-sensing voltage Vos, it takes a relatively short time compared to the sensing channel CH. For example, the detecting time Tchd of the dummy channel CHd can be 4 to 5 ms required to detect the dummy sensing voltage Vsend through the dummy sampling switch SAMd while the dummy channel CHd is initialized to the off-sensing voltage Vos.

Accordingly, while the time (Tch, for example 30 ms) for detecting the driving characteristic value of the subpixel SP through the sensing channel CH once, the dummy sampling switch SAMd for detecting the characteristic (gain or offset) of the analog-to-digital converter 132 through the dummy channel CHd can operate a plurality of times.

Here, the case has been discussed in which, while the sampling switch SAM connected to the sensing channel CH is turned on once, the dummy sampling switch SAMd connected to the dummy channel CHd is turned on four times.

In addition, a plurality of dummy sampling switches SAMd1-SAMdn connected to a plurality of dummy channels CHd1-CHdn can be turned on at the same time. Here, it has been discussed as one dummy sampling switch SAMd considering the case of turning on or off a plurality of dummy sampling switches SAMd1-SAMdn at the same time.

By arranging dummy sensing voltages Vsend1-Vsendn simultaneously detected from each dummy channel CHd1 to CHdn through the dummy sampling switch SAMd, it can be acquired the dummy sensing voltage for each line corresponding to one gate line GL.

Meanwhile, the dummy sensing voltage for each line obtained by one operation of turning on the dummy sampling switch SAMd can be used to correct the characteristics of the analog-to-digital converter 132, however, there may occur noise in the dummy sensing voltage for each line due to an internal factor or an external factor at the time when the dummy sampling switch SAMd is turned on.

Accordingly, while the sampling switch SAM connected to the sensing channel CH is turned on once, the dummy sampling switch SAMd connected to the dummy channel CHd can be turned on a plurality of times (for example, 4 times). In addition, the offset for the characteristics of the analog-to-digital converter 132 can be reduced by summing the dummy sensing voltages for each of the plurality of lines detected when the dummy sampling switch SAMd is turned on.

Figure 9:
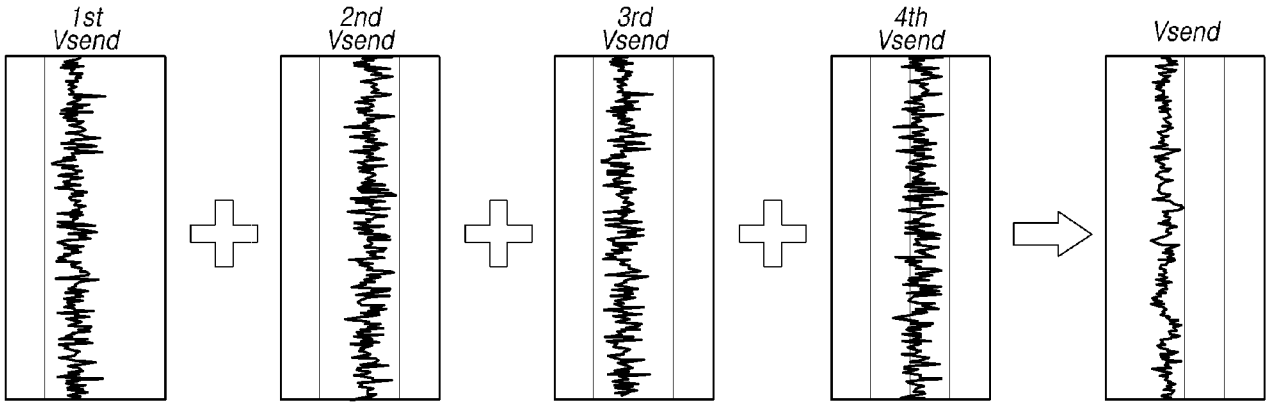
FIG. 9 illustrates a case in which an offset for a characteristic of an analog-to-digital converter is reduced by summing dummy sensing voltages detected multiple times through a dummy channel in a display device according to embodiments of the present disclosure.

FIG. 9 illustrates a case in which an offset for a characteristic of an analog-to-digital converter is reduced by summing dummy sensing voltages detected multiple times through a dummy channel in a display device according to embodiments of the present disclosure.

Referring to FIG. 9, in the display device 100 according to the embodiments of the present disclosure, due to an internal factor or an external factor at the time when the dummy sampling switch SAMd is turned on, the dummy sensing voltage Vsend detected through the dummy channel CHd can have a different value for each detecting time point.

For example, in the case of turning on the dummy sampling switch SAMd connected to the dummy channel CHd four times while the sampling switch SAM connected to the sensing channel CH is turned on once, four dummy sensing voltages can $1^{st}$ Vsend–$4^{th}$ Vsend be detected.

In this case, the four dummy sensing voltages 1st Vsend–$4^{th}$ Vsend can represent different values due to the time interval at the time when the dummy sampling switch SAMd is turned on or external factors.

However, even though the four dummy sensing voltages $1^{st}$ Vsend–$4^{th}$ Vsend have different values, all of them are values detected in the same dummy sensing channel CHd, so that a deviation for the dummy sensing channel CHd can be reduced when calculating the average value by summing all four dummy sensing voltages $1^{st}$ Vsend–$4^{th}$ Vsend.

Therefore, the dummy sensing voltage Vsend can be detected multiple times through the dummy channel CHd during the time while the sensing voltage Vsen is detected once through the sensing channel CH, and the average value thereof can be calculated by summing the dummy sensing voltages, so that it is possible to reduce an offset deviation for the characteristics of the analog-to-digital converter 132.

Figure 10:
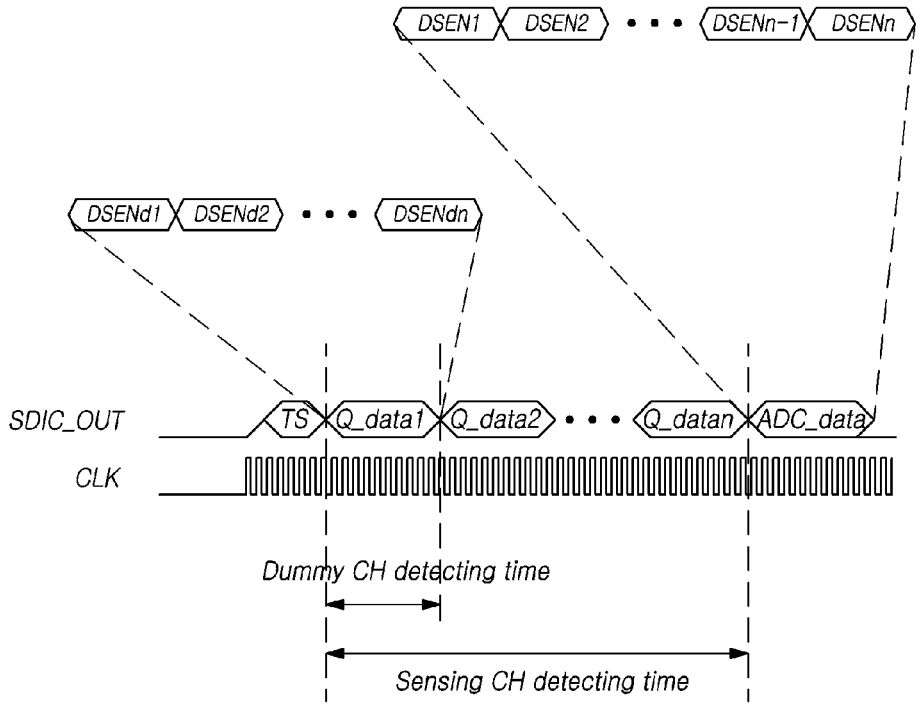
FIG. 10 illustrates an example of output data that is transmitted to a timing controller by converting a voltage detected through a sensing channel and a dummy channel in a data driving circuit into a digital signal in a display device according to embodiments of the present disclosure.

FIG. 10 illustrates an example of output data that is transmitted to a timing controller by converting a voltage detected through a sensing channel and a dummy channel in a data driving circuit into a digital signal in a display device according to embodiments of the present disclosure.

Referring to FIG. 10, in the display device 100 according to the embodiments of the present disclosure, the analog-to-digital converter 132 can detect a sensing voltage Vsen of a plurality of sensing lines SL connected by a sampling switch SAM, for example, a voltage formed at both ends of a line capacitor Cline, and can convert the sensing voltage Vsen into digital sensing data DSEN.

In this case, the data driving circuit 130 can configure digital sensing data DSEN1-DSENn detected through a sampling switch SAM for a plurality of sensing channels CH1-CHn into one integrated panel sensing data ADC-data. For example, in the case that 60 pixels each of which consisting of 4 subpixels SP are connected to one data driving circuit 130, 60 sensing channels CH can be arranged. In addition, in the case of generating 10-bit digital sensing data DSEN for each sensing channel CH, 600 bits of panel sensing data ADC-data can be generated.

Accordingly, the data driving circuit 130 can transmit output data SDIC OUT including the panel sensing data ADC data consisting of digital sensing data DSEN detected for a plurality of sensing channels CH to the timing controller 140.

In this case, during detecting the sensing voltage Vsen for the plurality of sensing channels CH, the data driving circuit 130 can repeat a process of detecting a dummy sensing voltage Vsend for a plurality of dummy channels CHd and converting the dummy sensing voltage Vsend into digital dummy sensing data DSENd1-DSENdn a plurality of times.

In this case, the plurality of digital dummy sensing data DSENd1-DSENdn generated from a plurality of dummy channels CHd can be configured as one offset data Q_data, and the data driving circuit 130 can create offset data Q_data1-Q_datan as many as the number of times of detecting the dummy sensing voltage Vsend from the dummy channel CHd.

The offset data Q_data is a value representing the dummy sensing voltage Vsend detected through the dummy channels CHd1, CHd2 to which the off-sensing voltage Vos is supplied. Accordingly, the timing controller 140 can determine the change in characteristics of the analog-to-digital converters 132*a*, 132*b*, 132*c* by comparing the offset data Q_data for the dummy channels CHd1, CHd2 with the characteristic values of the analog-to-digital converters 132*a*, 132*b*, 132*c* for each sensing channel CH stored in the lookup table.

In this case, since a number of times of detecting the dummy sensing voltage Vsend from the dummy channel CHd can be performed within the time for detecting the sensing voltage Vsen from the sensing channel CH, n pieces of offset data Q_data1-Q_datan can be generated during a period in which one panel sensing data ADC data is generated.

If one panel sensing data ADC data and n offset data Q_data1-Q_datan are generated, the data driving circuit 130 can transmit output data SDIC OUT including transfer start data TS to the timing controller 140.

Figure 11:
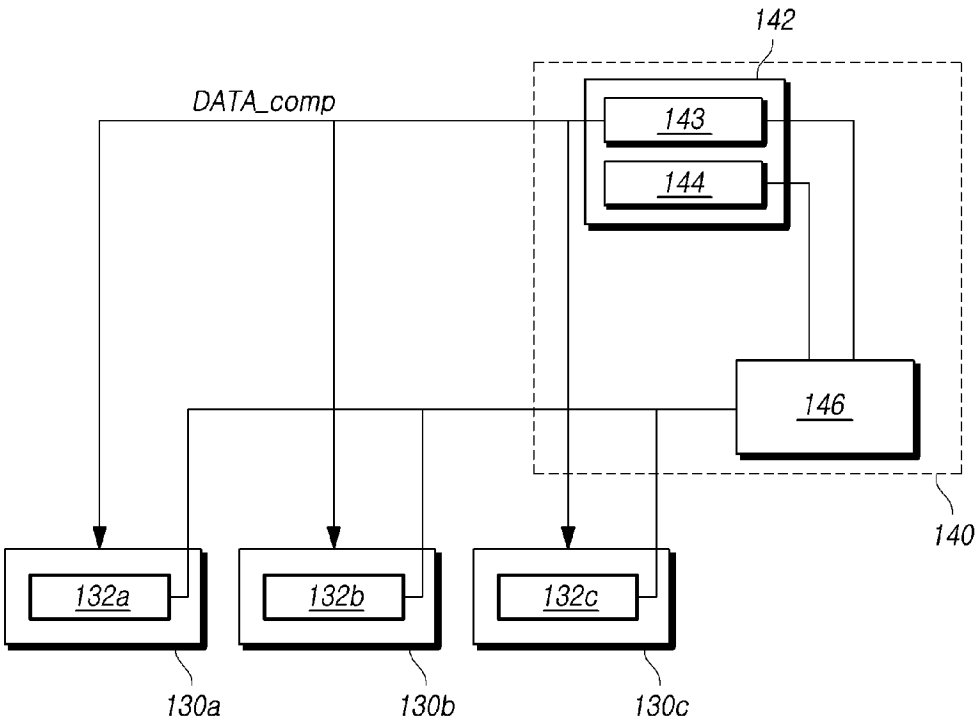
FIG. 11 schematically illustrates a configuration diagram for compensating a driving characteristic value of a subpixel and a conversion characteristic of an analog-to-digital converter in a display device according to embodiments of the present disclosure.

FIG. 11 schematically illustrates a configuration diagram for compensating a driving characteristic value of a subpixel and a conversion characteristic of an analog-to-digital converter in a display device according to embodiments of the present disclosure.

Referring to FIG. 11, in the display device 100 according to the embodiments of the present disclosure, the compensation circuit 142 of the timing controller 140 can include a subpixel compensation circuit 143 and an analog-to-digital converter compensation circuit 144.

In the case that the characteristic values of the analog-to-digital converters 132*a*, 132*b*, 132*c* are changed, in order to compensate for at least one of the characteristic value of the analog-to-digital converters 132*a*, 132*b*, 132*c* and a characteristic value deviation between the sensing channel CH connected to the analog-to-digital converters 132*a*, 132*b*, 132*c*, the analog-to-digital converter compensation circuit 144 of the timing controller 140 can compensate the characteristic values of the analog-to-digital converters 132*a*, 132*b*, 132*c* for each sensing channel CH by updating the lookup table in the memory 146.

For example, when it is determined that the characteristic values of the analog-to-digital converters 132*a*, 132*b*, 132*c* are changed through the dummy sensing voltage Vsend detected in the dummy channel CHd, in order to compensate for the change in the characteristic value of the analog-to-digital converters 132*a*, 132*b*, 132*c*, the analog-to-digital converter compensation circuit 144 can perform the analog-to-digital converter compensation that updates characteristic values (offset, gain, etc.) of analog-to-digital converters 132*a*, 132*b*, 132*c* for each sensing channel CH included in the lookup table in the memory 146.

Meanwhile, the subpixel compensation circuit 143 included in the timing controller 140 can refer to the lookup table updated by the analog-to-digital converter compensation circuit 144 and create compensated digital image data DATA comp from the digital sensing data DSEN detected in the sensing channel CH so as to compensate the characteristic value (such as a threshold voltage or mobility) for the driving transistor DRT in the subpixel SP.

Accordingly, the digital-to-analog converter in the data driving circuits 130*a*, 130*b*, 130*c* can convert the compensated digital image data DATA comp into a data voltage Vdata and supply it to the corresponding subpixel SP.

The display device 100 according to an embodiment of the present disclosure can detect a dummy sensing voltage Vsend for a dummy channel CHd two or more times, and can calculate an average value thereof after summing them, thereby reducing the characteristic values of the analog-to-digital converters 132*a*, 132*b*, 132*c*, in particular, offset deviation. Therefore, it is possible to solve the inaccuracy of subpixel compensation due to variation in characteristic values of the analog-to-digital converters 132*a*, 132*b*, 132*c*.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present invention.

The above description and the accompanying drawings provide an example of the technical idea of the present invention for illustrative purposes only. For example, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel having a plurality of subpixels and a plurality of sensing channels connected to the plurality of subpixels to detect a driving characteristic value;

a data driving circuit including an analog-to-digital converter configured to convert a sensing voltage detected from the plurality of sensing channels into digital sensing data, in which at least one dummy channel for applying a sensing driving voltage to detect a characteristic value of the analog-to-digital converter is connected to the analog-to-digital converter; and a timing controller configured to receive offset data detected in the at least one dummy channel from the analog-to-digital converter, and compensate for the characteristic value of the analog-to-digital converter, wherein, in the data driving circuit, while the digital sensing data is generated once from the plurality of sensing channels, the offset data is generated two or more times from the at least one dummy channel.

2. The display device of claim 1, wherein the driving characteristic value is a value representing a threshold voltage or mobility of a driving transistor constituting a subpixel among the plurality of subpixels.

3. The display device of claim 1, wherein the plurality of sensing channels are signal lines through which a reference voltage is applied to the plurality of subpixels.

4. The display device of claim 3, wherein the data driving circuit is configured to detect the sensing voltage by:

initializing the plurality of sensing channels to the reference voltage, tracking a voltage change for the plurality of sensing channels, and sampling the sensing voltage charged in the plurality of sensing channels after a predetermined time.

5. The display device of claim 1, wherein the at least one dummy channel is disposed outside the plurality of sensing channels, or is disposed between the plurality of sensing channels.

6. The display device of claim 1, wherein the data driving circuit is configured to detect the characteristic value of the analog-to-digital converter through an off-sensing process performed in a state in which a power-off signal is generated and a data voltage is cut off.

7. The display device of claim 6, wherein the sensing driving voltage is an off-sensing driving voltage.

8. The display device of claim 1, wherein the offset data generated two or more times are sequentially output during a period in which the digital sensing data is generated once.

9. The display device of claim 1, wherein the timing controller is configured to compensate the characteristic value of the analog-to-digital converter by comparing the offset data with a reference value stored in a memory.

10. The display device of claim 9, wherein the timing controller is configured to reduce a characteristic value deviation of the analog-to-digital converter by summing the offset data two or more times transmitted from the data driving circuit to calculate an average value.

11. The display device of claim 1, wherein the timing controller further includes:

a subpixel compensation circuit configured to compensate the driving characteristic value, by generating compensated digital image data from the digital sensing data and supplying the compensated digital image data to a corresponding subpixel.

12. A driving circuit comprising:

a plurality of data lines extending to a display panel on which a plurality of subpixels are disposed, and configured to supply a data voltage;

an analog-to-digital converter configured to convert a driving characteristic value detected from a plurality of sensing channels connected to the plurality of subpixels into digital sensing data; and at least one dummy channel connected to the analog-to-digital converter configured to supply a sensing driving voltage to detect a characteristic value of the analog-to-digital converter, wherein the analog-to-digital converter is configured to outputs the digital sensing data, and offset data detected from the at least one dummy channel, and wherein the offset data is generated two or more times from the at least one dummy channel while the digital sensing data is generated once from the plurality of sensing channels.

13. The driving circuit of claim 12, wherein the offset data is detected by an off-sensing process performed in a state in which a power-off signal is generated and a data voltage is cut off.

14. The driving circuit of claim 12, wherein the offset data generated two or more times are sequentially output during a period in which the digital sensing data is generated once.

15. The driving circuit of claim 12, wherein the driving characteristic value is detected by:

initializing the plurality of sensing channels to a reference voltage, tracking a voltage change for the plurality of sensing channels, and sampling a sensing voltage charged in the plurality of sensing channels after a predetermined time.

16. The driving circuit of claim 12, wherein the at least one dummy channel is disposed outside the plurality of sensing channels, or is disposed between the plurality of sensing channels.

17. The driving circuit of claim 12, wherein the sensing driving voltage is an off-sensing driving voltage.

* * * * *